US005335834A

United States Patent [19]

Verina

[11] Patent Number: 5,335,834

[45] Date of Patent: Aug. 9, 1994

[54] INFLATABLE CHILD-CARRYING SEAT

[76] Inventor: Ernest A. Verina, 7040 W. Palmetto Park Rd., Boca Raton, Fla. 33433

[21] Appl. No.: 51,991

[22] Filed: Apr. 26, 1993

[51] Int. Cl.[5] ..... A61G 1/00

[52] U.S. Cl. ..... 224/159; 224/257; 5/654; 5/451; 297/467

[58] Field of Search ..... 224/159, 158, 160, 161, 224/257, 265, 266, 264; 4/588; 5/654, 451, 644; 297/467, 452.41, DIG. 3

[56] References Cited

U.S. PATENT DOCUMENTS 682,871 9/1901 Hogan et al. ..... 5/644
3,610,489 10/1971 Parsons .
3,698,608 10/1972 Entwistle ..... 224/159
3,968,910 7/1976 Dye et al. .
4,416,403 11/1983 Johnson ..... 224/161
4,484,700 11/1984 Bush ..... 224/159
5,011,056 4/1991 Larreategus ..... 224/159

FOREIGN PATENT DOCUMENTS 1430355 1/1966 France ..... 5/644

*Primary Examiner*—Linda J. Sholl
*Attorney, Agent, or Firm*—Norman B. Rainer

[57] ABSTRACT

A seat for carrying a child in seated position upon an adult's shoulders is constructed as an inflatable device fabricated from flexible plastic sheet material interbonded in a manner to form a main portion of U-shaped contour whose extremities are bifurcated leg-cushioning portions. An abutment member is disposed atop the seat in a manner to be interposed between the child's groin and the back of the neck of the adult.

7 Claims, 2 Drawing Sheets

INFLATABLE CHILD-CARRYING SEAT

BACKGROUND OF THE INVENTION

1. Field of the Invention

This invention relates to a device for carrying a child, and more particularly concerns a device for carrying a child in seated position upon the shoulders of an adult.

2. Description of the Prior Art

Numerous devices have earlier been described whereby children can be carried by a large person such as a parent or other adult. One type of carrier is designed to carry the child papoose-style on the back of the adult, employing devices similar to camper's backpacks. The papoose-style carriers are well suited for carrying infants for relatively long periods of time. However, in the case of somewhat older children who have recently earned to walk, but tire quickly and must be carried for relatively short periods, shoulder-mounted carrier seats are preferably.

Shoulder-mounted seats for infants, as described in U.S. Pat. Nos. 4,484,700; 4,416,403 and elsewhere, are designed to enable the child to be seated upon the shoulders of the adult with his legs straddling the adult's head and extending downwardly upon the chest region of the adult. Such seats are generally constructed as collapsible structures amenable to easy carrying when not in use. However, despite their reduced size in the collapsed state, they are still considerably bulky and of significant weight. Although cushioning materials can be employed with such shoulder seats to provide greater comfort to the adult and child, further improvement in comfort during use is highly desirable.

It is accordingly an object of the present invention to provide a shoulder-mounted carrying seat for infants that is of light weight.

It is a further object of this invention to provide a carrying seat as in the foregoing object which is collapsible to a storage state that occupies little volume.

It is another object of the present invention to provide a carrying seat of the aforesaid nature which provides improved comfort to the child and adult.

It is a still further object of this invention to provide a carrying seat of the aforesaid nature which is easily deployed for use from a compact storage state, and is of simple construction amenable to low cost manufacture.

These objects and other objects and advantages of the invention will be apparent from the following description.

SUMMARY OF THE INVENTION

The above and other beneficial objects and advantages are accomplished in accordance with the present invention by a carrying seat for a child that enables the child to be seated upon the shoulders of an adult with his legs straddling the adult's head and extending downwardly upon the chest region of the adult, said carrying seat comprising an integral inflatable structure fabricated of flexible polymeric sheet material and comprised of a main portion bounded in part by interior and exterior seams of U-shaped contour and having an inflation valve, an arcuate rear region, opposed leg portions forwardly disposed from said rear region, and upper and lower surfaces. An abutment member is upwardly emergent from said upper surface in said rear region adjacent said interior seam. The carrying seat is of substantially symmetrical shape with respect to a plane orthogonal to said upper and lower surfaces and bisecting said rear port ion in parallel relationship to said leg portions.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
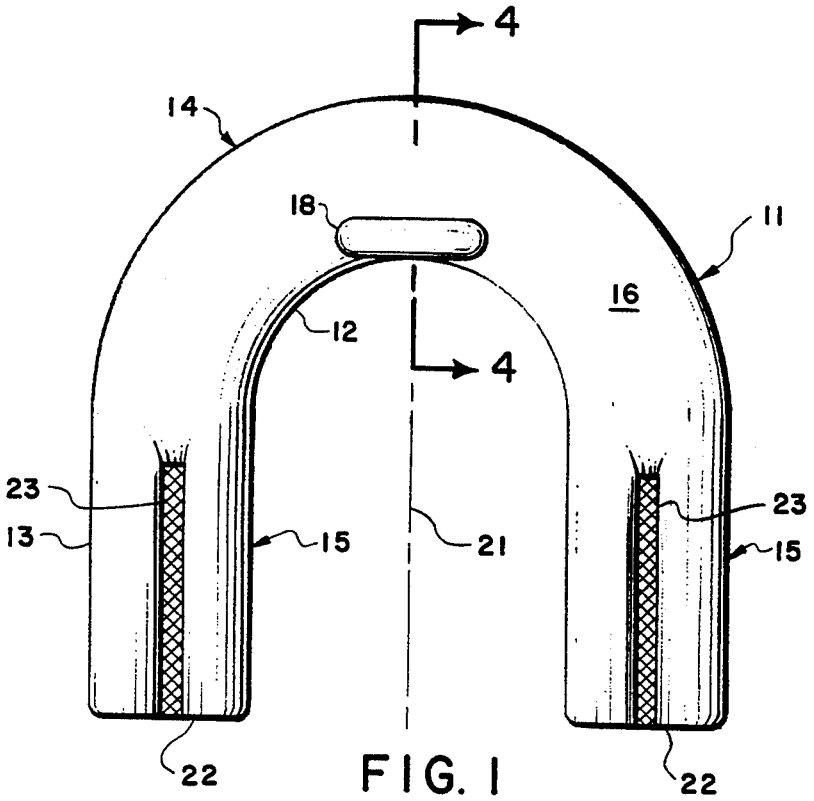
FIG. 1 is a top plan view of an embodiment of the carrying seat of the present invention.
Figure 2:
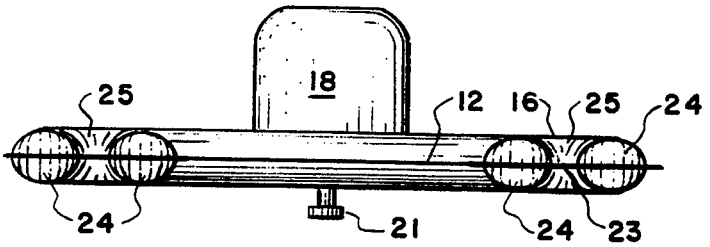
FIG. 2 is a front view thereof.

Referring to FIGS. 1–4, an embodiment of the carrying seat 10 of the present invention is shown comprised of an integral inflatable structure fabricated of flexible polymeric sheet material, Suitable polymeric sheet material includes, for example, plasticized polyvinyl chloride having a thickness in the range of 10–20 mils, The film may be clear or opaque and pigmented, The carrying seat is comprised of a main portion 11 of horseshoe or U-shaped configuration bounded in part by interior and exterior seams 12 and 13, respectively, The main portion is further characterized in having an arcuate rear region 14, opposed leg portions forwardly emergent from said rear region, and upper and lower surfaces 16 and 17, respectively.

Figure 3:
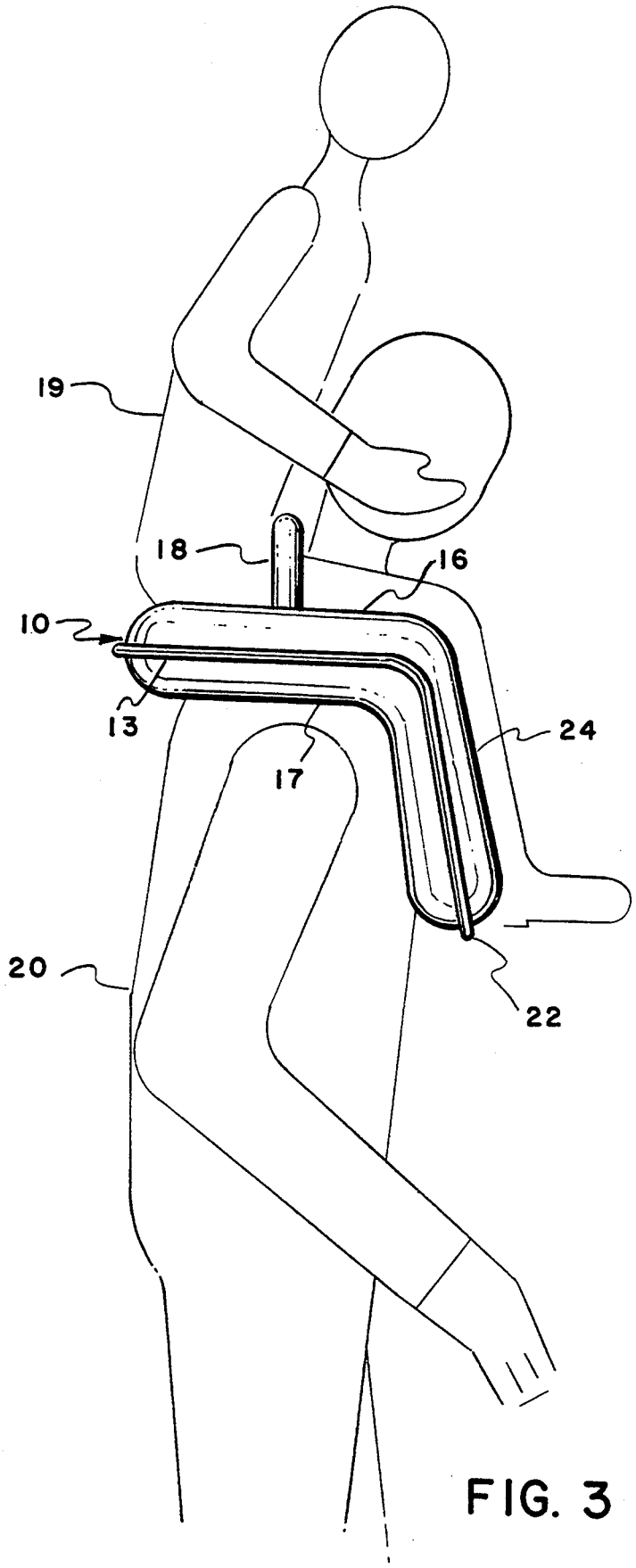
FIG. 3 is a side view thereof shown in functional relationship with a child sitting atop an adult's shoulders.

An abutment member 18 is upwardly emergent from upper surface 16 in said rear region 14 adjacent interior seam 12. As shown in FIG. 3, the function of the abutment member is to provide cushioning between the groin area of the child 19 and the back of the neck of adult 20.

Figure 4:
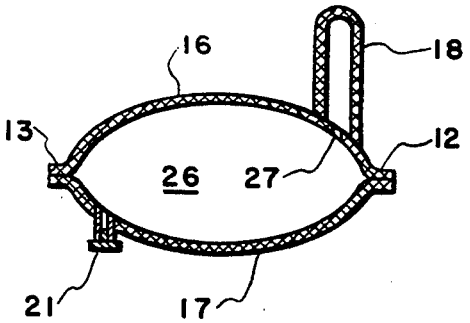
FIG. 4 is a sectional view taken upon the line 4—4 of FIG. 1.

A valve 21 to permit entrance and egress of air is downwardly emergent from lower surface 17 of rear region 14 adjacent interior seam 12. The valve may, however, be positioned in other locations. A suitable valve is Roberts valve #450-AC. The carrying seat is designed to function with an air pressure in the range of 0.5 to 3 psi. This is a range of pressure achievable by oral inflation. When inflated, rear region 14 will have an oval cross-sectional configuration as best shown in FIG. 4 and a height, measured as the maximum distance of separation between upper and lower surfaces between about 1.5 and 2.0 inches.

In the illustrated preferred embodiment, exterior seam 13 bordering rear region 14 is intended to have a radius of curvature of 8 inches, and opposing interior seam 12 has a radius of curvature of 4 inches, both radii originating from the same center located on center axis 21. Accordingly, the width of rear region 14, measured orthogonally between the interior and exterior seams, is 4 inches.

The leg portions 15 are parallel to and equidistantly separated from axis 21 which also represents a plane of symmetry for the exemplified embodiment. Said leg portions are straight, coplanar with rear region 14, and bounded by said interior and exterior seams and end seams 22 which extend between said interior and exterior seams. The leg portions are bifurcated by means of intervening seam 23 joining said upper and lower surfaces and causing the leg portions to be comprised of two side-by-side tubular regions 24 of oval cross section. In the exemplified embodiment, the interior and exterior seams that bound the leg portions are tangentially emergent from the curved portions of the seams that bound rear region 14. Accordingly, the width of each leg portion is about 4 inches, and each tubular region 24 is of about 2 inch width. Such dimensions have been found to accommodate most sizes, and afford adequate protection to both child and adult.

Because of the bifurcated nature of the leg portions they are readily folded downward under the weight of the child's legs. Also the groove 25 formed by intervening seam 23 helps to position the child's legs.

Main portion 11 can be produced from two sheets of suitable plastic material placed one atop the other and subjected to a cohesive sealing operation which generates the aforesaid seams. Dielectric bonding, ultrasonic welding and hot pressing are some of the possible sealing methods which may be employed to achieve cohesive interbonding of the sheets.

Abutment member 18, which may have a height of about 3 inches above upper surface 16, and a width of about 4 inches measured orthogonally to the plane of symmetry, is attached to main portion 11 by the aforesaid sealing methods. Said abutment member 18 communicates with the interior 26 of main portion 11 by way of aperture 27 within upper surface 18. By way of such manner of fabrication, abutment member 18 is inflated or deflated along with main portion 11. Accordingly, the carrying seat of this invention, when deflated, can be rolled or folded to a very compact, light weight storage state.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A carrying seat for a child that enables the child to be seated upon the shoulders of an adult with his legs straddling the adult's head and extending downwardly upon the chest region of the adult, said carrying seat comprising an integral inflatable structure fabricated of flexible polymeric sheet material and comprised of a main portion bounded in part by upper and lower surfaces and interior and exterior seams of U-shaped contour, having an inflation valve, an arcuate rear region, and opposed leg portions forwardly disposed as tangential extensions of said rear region, and an abutment member upwardly emergent from said main portion in said rear region adjacent said interior seam, said carrying seat being of substantially symmetrical shape with respect to a plane orthogonal to said upper and lower surfaces and bisecting said rear portion in parallel relationship to said leg portions.

2. The carrying seat of claim 1 wherein said sheet material is plasticized polyvinylchloride.

3. The carrying seat of claim 2 wherein said polyvinylchloride sheet material has a thickness in the range of 10–20 mils.

4. The carrying seat of claim 1 wherein said leg portions are bifurcated by way of an intervening seam joining said upper and lower surfaces and causing the leg portions to be comprised of two side-by-side tubular regions.

5. The carrying seat of claim 4 wherein said intervening seam forms a groove that helps to position the child's legs.

6. The carrying seat of claim 2 wherein said main portion is produced from two sheets of plasticized polyvinyl chloride by cohesive interbonding of said sheets.

7. The carrying seat of claim 6 wherein said abutment member communicates with said main portion by way of an aperture within said upper sheet.

* * * * *